US012188332B1

(12) United States Patent
Kaltveit et al.

(10) Patent No.: US 12,188,332 B1
(45) Date of Patent: Jan. 7, 2025

(54) DOWNHOLE SCRAPER FOR RADIAL AND AXIAL MOTION

(71) Applicant: Halliburton Energy Services, Inc., Houston, TX (US)

(72) Inventors: Håkon Rasmus Berdines Kaltveit, Tananger (NO); Alan Pace, Aberdeen (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/240,470

(22) Filed: Aug. 31, 2023

(51) Int. Cl.
*E21B 37/02* (2006.01)

(52) U.S. Cl.
CPC ..... *E21B 37/02* (2013.01)

(58) Field of Classification Search
CPC ..... E21B 37/02; E21B 43/34; C09K 8/34
USPC ..... 166/311
See application file for complete search history.

(56) References Cited

U.S. PATENT DOCUMENTS 7,823,663 B2 11/2010 Eddison
10,526,871 B2 * 1/2020 Tzallas ..... E21B 17/10
2014/0116712 A1 * 5/2014 Bansal ..... E21B 37/02 166/170
2014/0262277 A1 * 9/2014 Meeks ..... E21B 10/325 166/99
2016/0312582 A1 * 10/2016 Ali ..... E21B 37/02
2017/0089177 A1 3/2017 Xu et al.
2020/0080400 A1 * 3/2020 Garcia ..... E21B 37/04
2023/0021731 A1 1/2023 Hanson et al.

OTHER PUBLICATIONS

Foreign Communication from Related Application—International Search Report and Written Opinion of the International Searching Authority, International Application No. PCT/US2023/031714, dated May 29, 2024, 11 pages.

* cited by examiner

*Primary Examiner* — Zakiya W Bates
*Assistant Examiner* — Ashish K Varma
(74) *Attorney, Agent, or Firm* — Conley Rose, P.C.; Rodney B. Carroll

(57) ABSTRACT

A selective scraper tool configured to clean an inner surface of a downhole tubular comprising a scraper actuator configured to generate an activation force to deploy one or more scraper blades from corresponding windows on a blade assembly to contact the inner surface of the downhole tubular. A control device located between the scraper actuator and the blade assembly comprises a lug located within a control pattern with a first position and a second position. The first position configures the blade assembly in a retracted position. The second position deploys the scraper blades from the blade assembly. A pumping operation can direct the lug within the control pattern to travel from the first position to the second position.

22 Claims, 10 Drawing Sheets

DOWNHOLE SCRAPER FOR RADIAL AND AXIAL MOTION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are commonly obtained from subterranean formations that may be located onshore or offshore. The construction of a hydrocarbon producing well can comprise a series of construction steps designed to extract hydrocarbons efficiently and safely. The process typically begins with the selection of a drilling location based on geological studies and seismic data analysis. Once the drilling site is identified, a drilling rig is mobilized to the location.

The drilling operation commences with the drilling of the wellbore, which involves the use of a drill bit attached to the bottom of a drill string. The drill string is typically rotated, and a drilling mud, e.g., a combination of water, weighting materials, and additives, is circulated down the drill string and back up the annular space between the drill string and the wellbore walls. This process serves multiple purposes, including cooling and lubricating the drill bit, stabilizing the wellbore, and carrying rock cuttings to the surface.

Once the desired depth is reached, the drilling phase of the wellbore construction process is completed, and the wellbore can be isolated from wellbore fluids. A primary cementing operation comprises the installation of casing, also referred to as a casing string, which consists of metal tubulars, e.g., steel pipes, coupled together, placed into the wellbore, and cemented in place. The cementing operation can place a cement slurry tailored for the wellbore environment within an annular space between the casing and the wellbore. The cemented casing string provides structural integrity, prevents well collapse, and isolates different geological formations to ensure the flow of hydrocarbons from the target zone. The cementing operation can comprise multiple strings of casing extending from a previous casing string. For example, a bottom of a first casing string, e.g., a float shoe, can be drilled out to extend the wellbore past the first casing string. A second casing string can be installed through the first casing string by a second cementing operation. Likewise additional casing strings, e.g., a third and fourth casing strings, can be installed through each subsequent casing string.

During a completion stage, various completion equipment can be installed into the wellbore and the casing string can be opened to couple the wellbore to a target production zone, e.g., hydrocarbon bearing reservoir. However, before the completion equipment is installed, a wellbore cleaning operation can clean the inner surface of the casing and replace the drilling fluids, e.g., drilling mud, present in the wellbore with a completion fluid such as brine. The cleaning operation serves to remove solids adhered to the wall of the casing or liner, e.g., the inner surface, to circulate residual drilling mud and other fluids out of the wellbore, and to filter out solids present in the wellbore fluid. A considerable amount of debris in the wellbore and on the inner surface of the casing/liner comprises rust particles, metal chips, drilled out equipment, or scrapings originating from equipment utilized during the construction process.

Various types of cleaning tools are known, one of which is generically referred to as a casing scraper. Tools of this type typically incorporate casing scraper blades designed to scrape the inner surface of the casing/liner to remove relatively large particles or debris from the inner surface of the casing. In some scenarios, it may be advantageous to retract or disable the scraper blades after cleaning a portion of the wellbore, for example, to prevent dislodging debris at another depth. In some scenarios, it may be advantageous to rotate the drill pipe, for example, while drilling with the casing scraper blades stationary or mostly stationary. In some scenarios, it may be advantageous to rotate the scraper blades via the drill pipe. A method to selectively configure a casing scraper downhole with stationary scraper blades, with rotatable scraper blades, or to retract the scraper blades is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
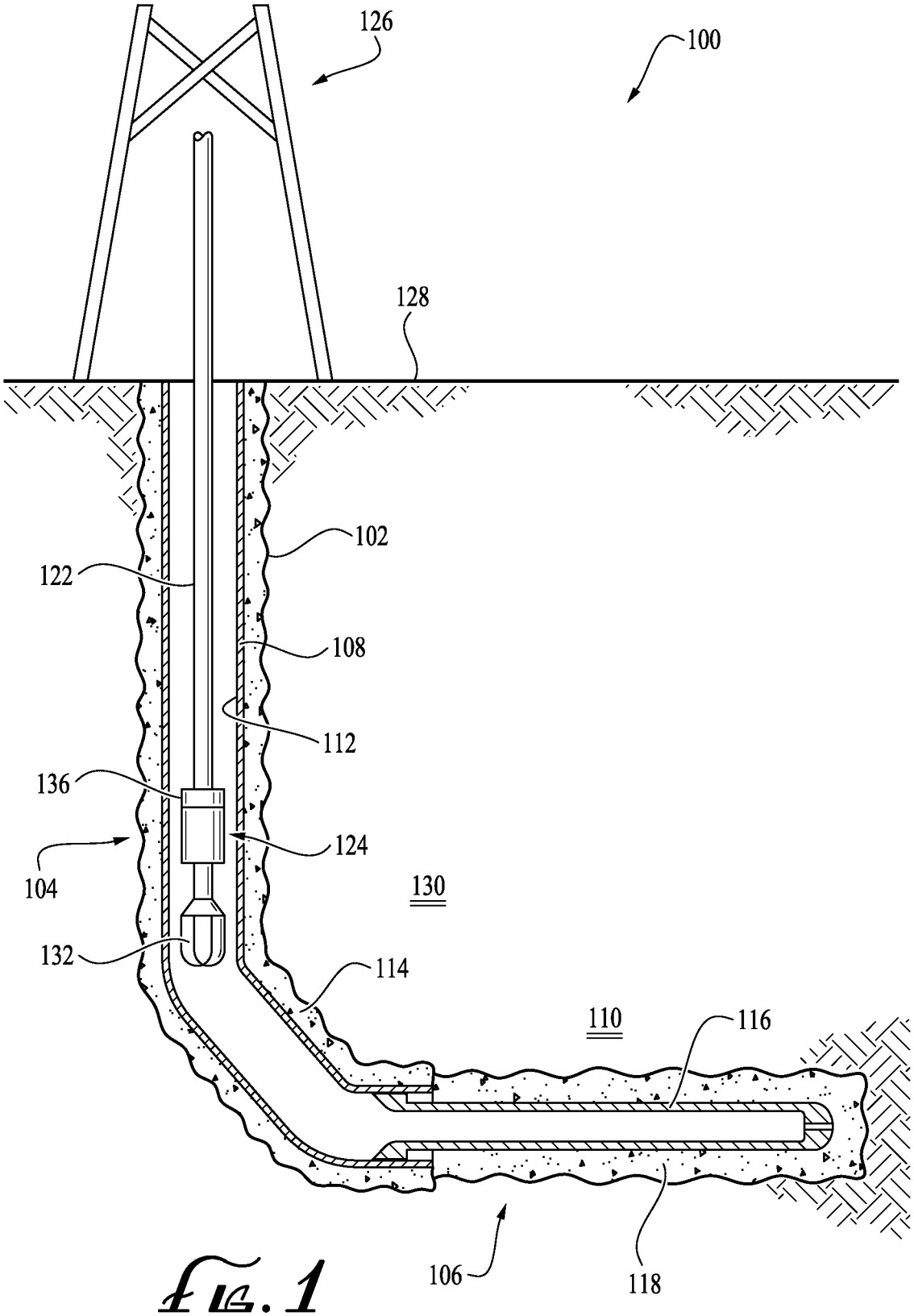
FIG. 1 is a diagram illustrating an exemplary environment for a wellbore cleaning operation according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

Prior to the completion operations, a cleanout operation can remove drilling mud and debris from a wellbore. The cleanout operation may include a cleanout string, e.g., one or more cleanout tools, conveyed into a wellbore to a target depth, for example, the bottom or toe of the wellbore. The cleanout string can include one or more cleanout tools configured to remove debris, for example, a casing scraper, a circulating tool, a downhole fluid filter, a magnet tool, a junk basket, or combinations thereof. The cleanout string can be conveyed on a workstring configured to circulate fluid into the wellbore to clean and/or replace the wellbore fluids.

Typically, a casing scraper comprises a set of scraper blades extending from a housing to contact an inner surface of the casing. Each scraper blade can have a generally rectangular cross-section with an outer arc shape configured to contact or scrape the inner surface of the casing. The scraper blades can be fixed or spring loaded. The set of scraper blades can be located or positioned around the circumference of a mandrel to contact or scrape all 360 degrees of the inner surface. The casing scraper is typically conveyed into the wellbore on drill pipe, tubing, coil tubing, or any other suitable tubular.

The cleanout operation may target a portion of the wellbore for cleaning, for example, adjacent to a formation. The cleanout string may be disabled, or configured to not clean, during the conveyance to the target cleaning location. In some embodiments, the cleanout string can include a casing scraper configured in a run-in position or disabled position. In the run-in position, the scraper blades of the casing scraper can be retained away from the inner surface of the casing. The scraper blades can be activated, or configured to scrape, by a signal from the surface, e.g., applied pressure. The casing scraper can clean the inner surface of the wellbore along the target zone or portion of the wellbore. In some embodiments, the casing scraper can be transitioned from the activated position back to the run-in position. For example, the casing scraper can retract or return the scraper blades to the run-in position.

In some scenarios, the cleanout operation may utilize a casing scraper during a drilling operation. For example, a casing scraper may be placed proximate to a drill bit or milling shoe. The casing scraper may allow for rotation of the drilling string during the drilling operation while not rotating the scraper blades. In some embodiments, the mandrel of the casing scraper can rotate independently of the set of scraper blades. For example, the casing scraper may be configured in an active position with the scraper blades contacting or cleaning the wellbore. The scraper blades may remain stationary while the mandrel of the casing scraper rotates with the workstring.

In some scenarios, the cleanout operation may utilize a casing scraper to remove obstructions from the inner surface of the casing. For example, hardened material such as cement, scale, paraffin, or perforation burrs may adhere and/or protrude from the inner surface of the casing to obstruct the flow path of the casing. In some embodiments, the casing blades can be configured to rotate with the mandrel of the casing scraper while contacting the inner surface of the wellbore. The contact or cleaning of the inner surface while rotating can remove hardened substances, e.g., cement, mud, and paraffin, and can remove casing or completion equipment material protruding into flow path, e.g., perforation burrs, portions of downhole tools, and deformation of the casing. In this configuration, the scraper blades may be keyed to and rotate with the mandrel of the casing scraper as the casing scraper rotates with the workstring.

The cleanout operation may determine that a different type of casing scraper is desirable during a portion of the cleanout operation. For example, the casing scraper may be conveyed into the wellbore in a non-rotating configuration, e.g., the scraper blades move independent from the mandrel, and service personnel determine a need for a rotating configuration, e.g., a tight spot. Typically, the workstring must be tripped out, e.g., conveyed back to surface, to exchange or reconfigure the casing scraper to a rotating configuration. A casing scraper that is configurable downhole is desirable.

A casing scraper with a surface activated selective configuration can provide a solution to configuring the casing scraper in the wellbore. In some embodiments, a selective casing scraper can comprise extendable and retractable scraper blades. For example, the selective casing scraper can be configured in a run-in position with the set of scraper blades retracted or away from the inner surface of the casing. An activation mechanism can reconfigure the casing scraper to an activated configuration by deploying the set of scraper blades to contact the inner surface of the casing. The selective casing scraper can be activated in a first configuration, e.g., non-rotating configuration. A surface signal, e.g., pressure or flowrate, can activate or initiate the activation method. In some embodiments, the selective casing scraper can be reconfigured from a first configuration to a second configuration. For example, the selective casing scraper can be reconfigured from a non-rotating configuration to a rotating configuration. The selective scraper can include a control mechanism that can reconfigure the selective casing scraper from a first configuration to a second configuration. In some embodiments, the control mechanism can reconfigure the selective casing scraper from a first configuration, to a second configuration, and/or to a third configuration.

Turning now to FIG. 1, an exemplary wellsite environment 100 for a cleanout operation is illustrated. In some embodiments, wellsite environment 100 comprises a wellbore 102 extending from a surface location to a permeable subterranean formation 110. The wellbore 102 can be drilled through a subterranean formation 130 from surface location 128 using any suitable drilling technique. The wellbore 102 can include a substantially vertical portion 104 that transitions to a deviated portion and into a substantially horizontal portion 106. In some embodiments, the wellbore 102 may comprise a nonconventional, horizontal, deviated, multilateral, or any other type of wellbore. Wellbore 102 may be defined in part by a casing string 108 that may extend from a surface location to a selected downhole location. The casing string 108 may be isolated from the wellbore 102 by cement 114. Portions of wellbore 102 that do not comprise the casing string 108 may be referred to as open hole. Although the horizontal portion 106 is illustrated with a liner string 116, e.g., secondary casing and cement 118, it is understood that the horizontal section can include an open hole section, an open hole completion, a liner string, a cement section, or combinations thereof. While the wellsite environment 100 illustrates a land-based subterranean environment, the present disclosure contemplates any wellsite environment including a subsea environment. In one or more embodiments, any one or more components or elements may be used with subterranean operations with equipment located on service platforms 126, offshore platforms, drill ships, semi-submersibles, drilling barges, and land-based rigs.

A cleanout string 124 may be conveyed into the wellbore 102 by a workstring 122 extending from a service platform 126. The workstring 122 can be any piping, tubular, or fluid conduit including, but not limited to, drill pipe, workover tubing, production tubing, casing, coiled tubing, and any combination thereof. The workstring 122 can provide a conduit for the cleaning operation to deliver fluids to the cleanout string 124 or extract fluids from the interior of the casing string 108 as will be described further herein.

In some embodiments, the cleanout string 124 can include a drill bit 132, milling shoe, or other suitable drilling device. The cleanout string 124 can be conveyed into the wellbore 102 and/or casing string 108 to drill out or remove one or more completion tools, for example, a frac plug. The drill bit 132 can locate and/or contact the completion tool and the workstring 122 can be rotated to drill out or remove the completion tool. Drilling fluid or completion fluid can be pumped down the workstring 122 during the drilling operation to lift out or remove the cuttings from the interior of the casing string 108.

In some embodiments, the cleanout string 124 comprises a selective casing scraper 136. The selective casing scraper 136 can be conveyed into the wellbore 102 and/or casing string 108 on the workstring 122 alone or as a portion of the cleanout string 124. Said another way, the cleanout string 124 can comprise the selective casing scraper 136 alone or with other downhole tools, e.g., a junk basket. In some embodiments, the selective casing scraper can be configured in a run-in position with a set of scraper blades retracted or away from the inner surface 112 of the casing string 108. An activation process can reconfigure the selective casing scraper 136 to an activated configuration by deploying the set of scraper blades to contact the inner surface 112 of the casing string 108. In some embodiments, the selective casing scraper 136 can be reconfigured from a first configuration, e.g., a run-in configuration, to a second configuration, e.g., an active configuration, and returned to the first configuration. For example, the cleanout string 124 can be conveyed into the casing string 108 to locate, e.g., contact, a completion tool or cementing tool within the wellbore 102. The selective casing scraper 136 can be activated from surface by reconfiguring the selective casing scraper 136 from a run-in position to an active position, e.g., scraper blades in contact with the inner surface 112 of the casing string 108.

Turning now to FIG. 2, a partial cross-sectional view of a selective casing scraper tool can be described. In some embodiments, a selective casing scraper tool 200 can be an embodiment of the selective casing scraper 136 shown in FIG. 1. The selective casing scraper tool 200, also referred to as a selective tool, comprises a blade assembly 210, a position control device 212, and a scraper actuator 214. The blade assembly 210 can extend and retract one or more scraper blades 220, alternatively referred to as scraper heads, in response to the position control device 212. The scraper actuator 214 can direct the position control device 212 to change positions. A downhole end 236 of the blade assembly 210 can couple to the workstring 122. An uphole end sub 296 of the second mandrel 254 can couple to the workstring 122.

In some embodiments, the blade assembly 210 comprises a first stabilizer 222, a first mandrel 224, a housing 226, one or more scraper blades 220, a second stabilizer 228, and a wedge 230. The first stabilizer 222 can be generally cylinder in shape with an outer surface 232, an inner surface 234, and a downhole end 236. The outer surface 232 of the first stabilizer 222 can centralize or position the blade assembly 210 a predetermined distance from the inner surface 112 of the casing string 108. The inner surface 234 can define a fluid passage through the blade assembly 210. The downhole end 236 can be releasably coupled to a workstring, e.g., workstring 122. The first stabilizer 222 can be coupled to a first mandrel 224. The first mandrel 224 can be generally cylinder shape with an outer surface 238 and an inner surface that can be a continuation of inner surface 234. The first mandrel 224 can be coupled to the second stabilizer 228. The second stabilizer 228 can be generally cylinder in shape with an outer surface 240, an inner surface, and one or more rod ports 242. The outer surface 240 of the second stabilizer 228 can be the same general size or circumference as the outer surface 232 of the first stabilizer 222. The housing 226 can be generally cylinder shape with an outer surface 244, an inner surface 246, and one or more windows 248. The inner surface 246 of the housing 226 can have a sliding fit onto an outer surface 250 on the first stabilizer 222 and an outer surface 252 on the second stabilizer 228. In some embodiments, the housing 226 can be configured to rotate about the first stabilizer 222 and the second stabilizer 228. One or more scraper blades 220, alternatively referred to as scraper heads, can be a generally cubic shape with an outer surface 256 and an inner surface 258. The outer surface 256 can be generally arc shape and configured with curvature to generally fit, conform, or mate with the curvature of the inner surface 112 of the casing string 108. The sides of the scraper blades 220 can be configured with an allowance fit inside the one or more windows 248 of the housing 226. In a first configuration, e.g., a run-in configuration, the inner surface 258 of the one or more blades 220 can abut or contact a lower surface 260 of the wedge 230. In some embodiments, a housing spring 324 can bias the wedge 230 to the first configuration. In a second configuration, e.g., extended configuration, the one or more scraper blades 220 can abut or contact an upper surface 262 of the wedge 230 as will be described further herein.

In some embodiments, the position control device 212 can be generally cylinder in shape with an outer surface and an inner surface 266 with an allowance fit with an outer surface 268 of a second mandrel 254. A control pattern 270, e.g., one or more slots, can be located along the inner surface 266 of the position control device 212. A lug 272 can travel within the control pattern 270 as will be described further herein. The lug 272 can be coupled to a lug ring 274. In some embodiments, the lug 272 and lug ring 274 can rotate within a ring groove 277 on the outer surface 268 of the second mandrel 254. In some embodiments, the lug 272 and lug ring 274 can be coupled to the ring groove 277, e.g., non-rotatable. An actuator cover 264 can be a generally cylinder shape with an outer surface, an inner surface, and releasably coupled to the second stabilizer 228 and the uphole end sub 296.

In some embodiments, the scraper actuator 214 comprises a piston assembly 208 abutting a metering assembly 206. The piston assembly 208 comprises a piston cylinder 276 sealingly coupled to a piston boss 278 and a seal surface 280 of the second mandrel 254. The piston cylinder 276 can be generally cylinder in shape with a seal 284 located within a circumferential groove on an inner surface 282. A fluid chamber 288 can be formed by an inner surface 290 and a front face 292 of the piston cylinder, the seal surface 280 of the second mandrel 254, and an end face 294 of the piston boss 278. A fluid port 298 can fluidically couple the fluid chamber 288 to the fluid passage 234 of the selective tool 200. In some embodiments, a flowrate of wellbore fluids 302 pumped through the fluid passage 234 via the workstring 122 can generate an increase in fluid pressure at a restriction 304 located proximate to the fluid port 298. The fluid pressure within the fluid chamber 288 can activate the piston assembly 208 as will be described further herein.

In some embodiments, the metering assembly 206 comprises a first metering chamber 316, a second metering chamber 318, and a metering device 314. The first metering chamber 316 can be defined by a first end sub 306, a housing 308, a piston boss 312, and the seal surface 280 of the second mandrel 254. The second metering chamber 318 can be defined by a second end sub 310, the housing 308, the piston boss 312, and the outer surface 268 of the second mandrel 254. Although the metering assembly 206 is illustrated as a separate assembly from the piston assembly 208, it is understood that the metering assembly 206 and piston assembly 208 can be combined. For example, the piston cylinder 276 of the piston assembly 208 can be couple to or combined with the first end sub 306 of the metering assembly 206. The metering device 314 can be an orifice, a nozzle, a jet, a check valve, a pressure relief valve, or any other suitable metering device and fluidically couple the first metering chamber 316 with the second metering chamber 318. Although a single unit of the metering device 314 is illustrated, it is understood that there may be 1, 2, 3, 4, 5, 6, 7, 8, 9, 10, or more metering devices 314 and the metering devices may be of different types, e.g., two nozzles and one check valve. In a context, the metering device 314 can be referred to as a nozzle 314. The metering assembly 206 can be filled with a volume of substantively incompressible fluid, such as hydraulic fluid, transmission fluid, dielectric fluid, water, other similar fluid. The metering assembly can be configured to transfer a volume of fluid from one fluid chamber to another fluid chamber via the nozzle 314. For example, a linear force, e.g., force parallel to the central axis of the selective tool 200, can generate an increase in fluid pressure within first chamber 316 and the transfer of fluid at a designated flowrate through the nozzle 314 and into the second chamber 318. The nozzle 314 can transfer fluid at a predetermined flowrate and thus, within a predetermined time period for the volume of fluid. In some embodiments, the metering assembly 206 can be configured to apply a predetermined activation force for a predetermined amount of time as will be disclosed further herein.

Figure 2A:
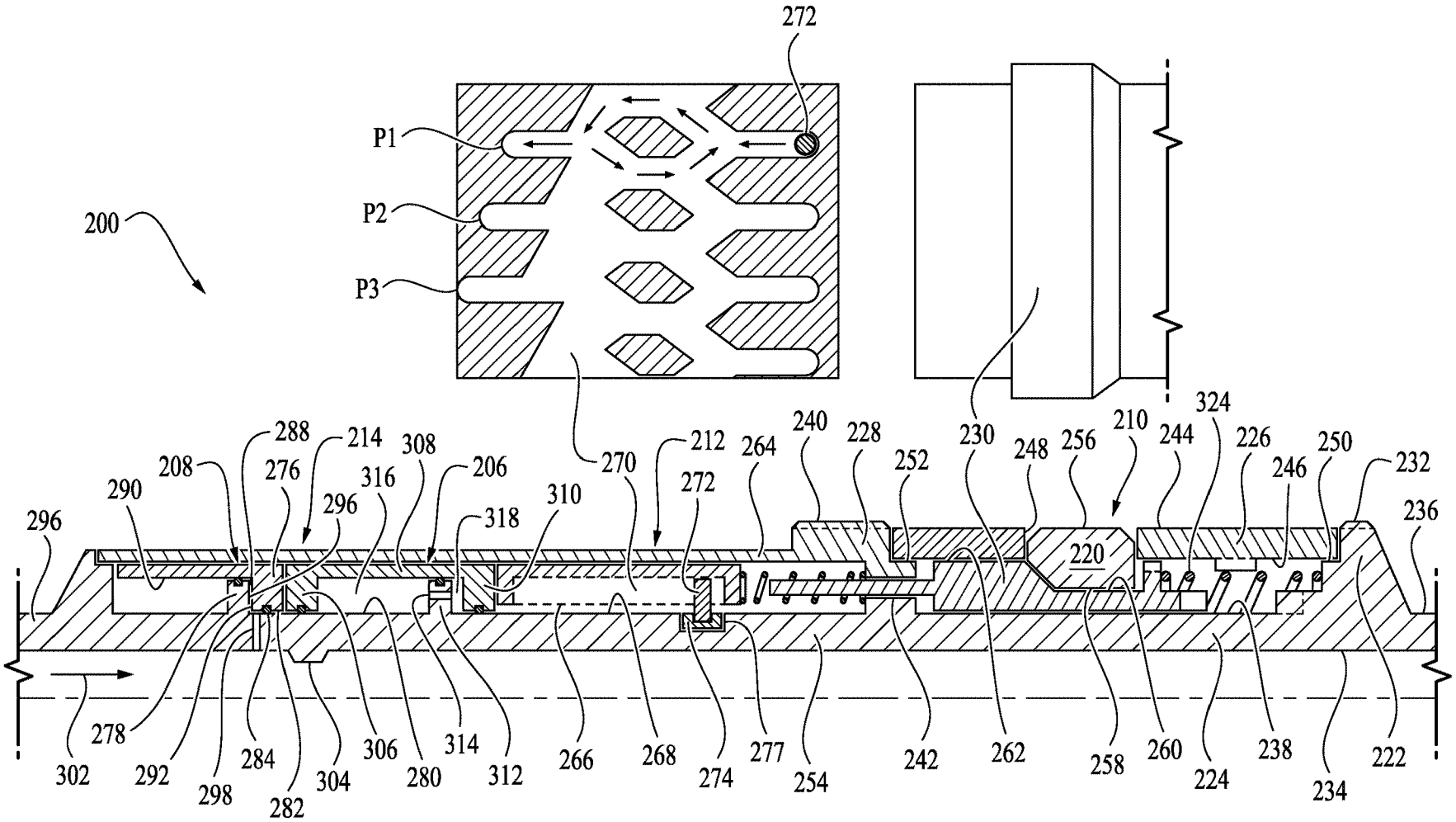
FIG. 2A is a partial cross-sectional view of a selectable scraper tool in a reset position according to an embodiment of the disclosure.
Figure 2B:
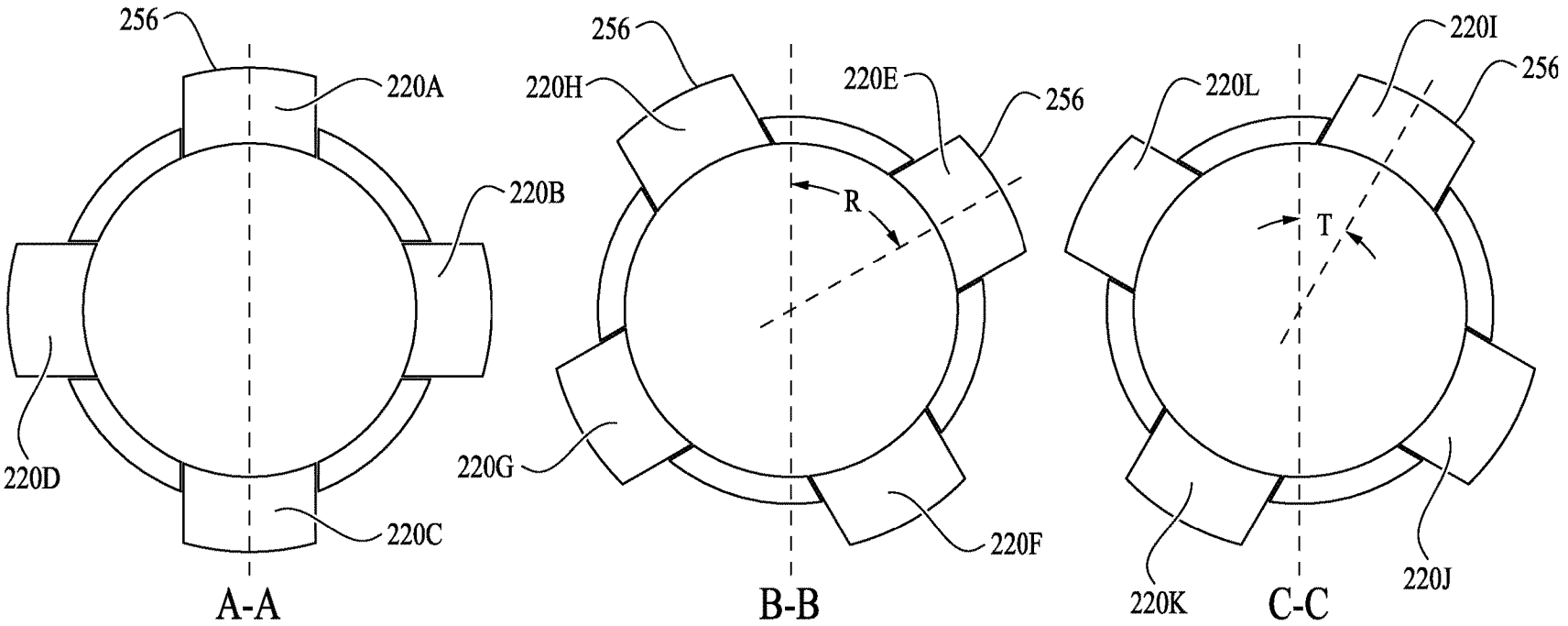
FIG. 2B is a partial cross-sectional view of a scraper assembly of the selectable scraper tool according to an embodiment of the disclosure.
Figure 2B:
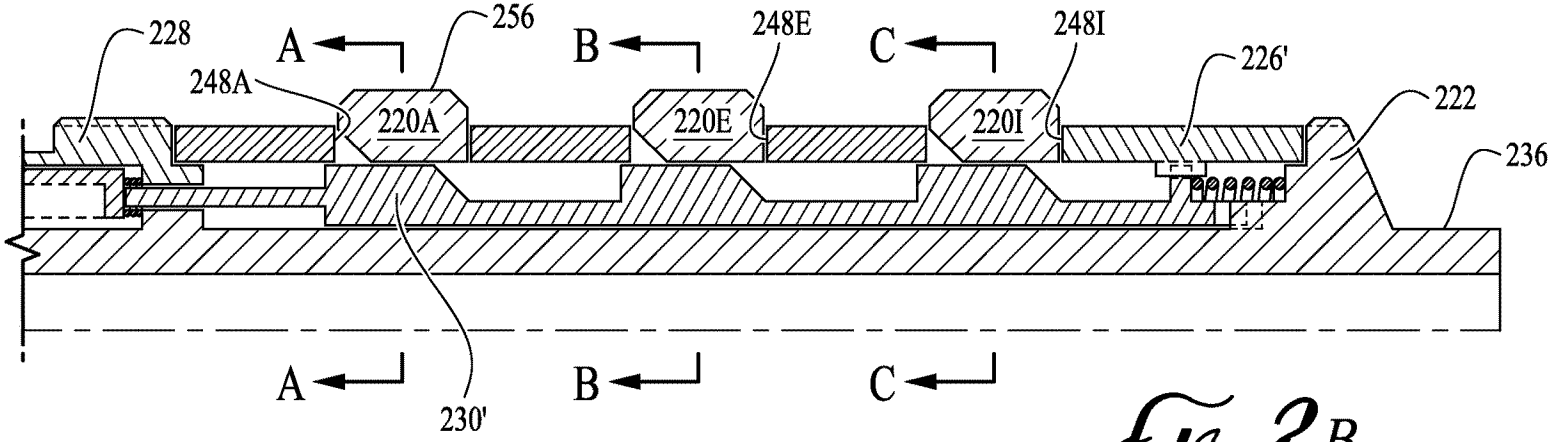

Although the selective tool 200 in FIG. 2A is illustrated with one scraper blade 220 inside a window 248 of the housing 226, it is understood that the blade assembly 210 can have a plurality of scraper blades 220 and/or multiple rows of scraper blades 220 along the housing 226. Turning now to FIG. 2B, an exemplary blade assembly with multiple scraper blades 220A-L can be described. In some embodiments, the blade assembly 210' can include three or more scraper blades 220 within corresponding windows 248 angularly distributed about the housing 226' in three rows. Each of the rows of scraper blades 220 can be configured, e.g., angularly distributed about a central axis of the blade assembly 210', to provide 360 degrees of contact along the inner surface 112 of the casing string 108. As illustrated with the exemplary blade assembly 210' of FIG. 2B, a first row of windows 248 can comprise four blades 220A-D evenly distributed at 90 degrees about the centerline of the blade assembly 210'. A second row of windows can comprise four blades 220E-H evenly distributed at 90 degrees and rotated an angle of "R" from the first row. A third row of windows can comprise four blades 220I-L evenly distributed at 90 degrees and rotated an angle of "T" from the first row. In the exemplary blade assembly 210', the second row of four blades 220E-H can be rotated 60 degrees from the first row and the third row of four blades 220I-L can be rotated 30 degrees from the first row to provide 360 degrees contact between the outer surface 256 of the scraper blade 220 and the inner surface 112 of the casing string 108. Although the blade assembly 210' is illustrated with 3 rows of four blades 220, it is understood that any combinations of rows and rotational spacing of blades can provide 360 degrees of contact. For example, the blade assembly 210' can comprise 1, 2, 3, 4, 5, 6, 7, 8, 9, 10, 11, 12, or any number of scraper blades 220 angularly distributed in each row with 1, 2, 3, 4, 5, 6, 7, 8, 9, 10, or any number of rows of scraper blades 220 to provide a combination configured for 360 degrees of outer surface 256 contact with the inner surface 112 of the casing 108.

Figure 2C:
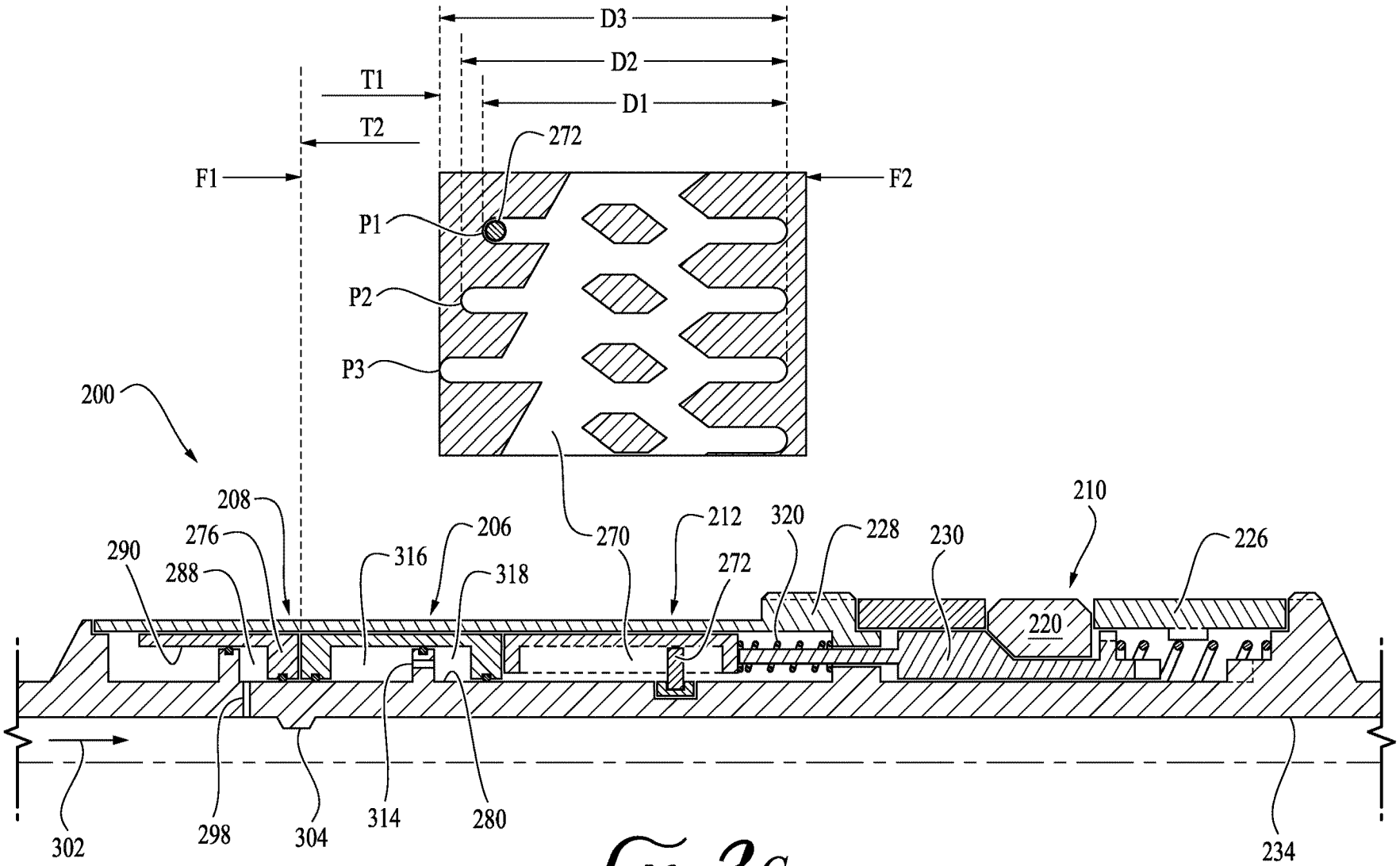
FIG. 2C is a partial cross-sectional view of a selectable scraper tool in a first position according to an embodiment of the disclosure.

The selective tool 200 can be activated or cycled to one of three different functions by applying a predetermined pressure during a predetermined time interval. In some embodiments, the selective tool 200 can be cycled to a position, e.g., a second position, by a continuous flowrate of wellbore fluids 302, e.g., drilling fluid, through the fluid passage 234 via the workstring 122. The term pumping pressure "P" can be defined as the fluid pressure within the fluid passage 234 of the selective tool 200 can be increased proximate or adjacent to the fluid port 298 as a result of the flowrate of wellbore fluids 302 passing through the restriction 304. Turning now to FIG. 2C, the selective tool 200 can cycle from a first position, e.g., run-in position, to a second position, e.g., non-active position. The pumping pressure "P" can create a differential pressure within chamber 288, e.g., higher pressure inside fluid chamber 288 compared to pressure outside of the piston assembly 208. An activation force "F", e.g., axial force parallel to the longitudinal axis, can be generated from the cross-sectional area "A1" of the inner surface 290 and the seal surface 280. The piston cylinder 276 can move or axially translate to contact the first end sub 306 of the metering assembly 206 in response to the activation force. The activation force "F" can transfer from the as piston 208 to the metering assembly 206 and to the control device 212 by direct contact if separate assemblies or via a coupled connection. The activation force "F1" can initiate a transfer of fluid from the first chamber 316 to the second chamber 318 via the nozzle 314. The activation force "F1" can increase the pressure of the volume of fluid in the first chamber 316 by bias or moving the first end sub 306 towards the piston boss 312 which decreases the volume of the first chamber 316 and increases the volume of the second chamber 318. The volume of fluid can be defined as the volume of the first chamber 316, the volume of the second chamber 318, and a volume of fluid located within the nozzle 314. The volume of the first chamber 316 can be defined as a cross-sectional area A2, e.g., inner surface of the housing 308 to the seal surface 280 of the second mandrel 254, and a linear distance "D," e.g., axial distance from the end face of the sub 306 to an end face of the piston boss 312. The change in the volumes of the chambers 316, 318 can generate a pressure differential across the nozzle 314 which initiates the transfer of fluid through the nozzle 314 at a predetermined flowrate. The flowrate through the nozzle 314 can be i) dependent or ii) independent on the pressure differential depending on the type of nozzle utilized.

A metering time "T" for the metering 206 to transfer a volume of fluid can be predetermined based on the nozzle 314, e.g., metering device. In some embodiments, the metering time "T" can be a function of volume, force "F," and the characteristics of the nozzle 314. For example, a metering time "T1" can be determined for a first force "F1", e.g., activation force "F," a distance "D," and the nozzle 314. Likewise, a metering time "T2" can be determined for a second force "F2," e.g., return force, a distance "D" and the nozzle 314. In some embodiments, the force "F1" is the activation force, e.g., force generated by the piston assembly 208. In some embodiments, the force "F2" is a biasing force of one or more return springs 320. In some embodiments, the metering time "T1" and "T2" can be equivalent or nearly equivalent based on the forces "F1" and "F2" and the nozzles 314. In some embodiments, the metering time "T1" and "T2" can be different based on the forces "F1" and "F2" and the nozzles 314. In one scenario, the forces "F1" and "F2" are equivalent and the nozzle 314 may comprise a set of metering devices configured to restrict fluid transfer in one direction and allow fluid transfer in another direction, for example the nozzle 314 comprises an orifice and a check valve. In a second scenario, the forces "F1" and "F2" are different, e.g., "F1" is greater than "F2," and the nozzle 314 can comprise two or more nozzles and/or orifices configured restrict fluid transfer in both directions. In a third scenario, the forces "F1" and "F2" can be different and the nozzle 314 can be configured to restrict fluid transfer in one direction and allow fluid transfer in the opposite direction, e.g., one or more orifices, a pressure relief valve, a flow metering valve, a check valve, or combinations thereof.

The distance "D" can be limited by the control pattern 270 within the inner surface 266 of the position control device 212. A first distance "D1" can be the axial distance for the lug 272 to travel within the pattern 270 to a first position "P1." A second distance "D2" can be the axial distance for the lug 272 to travel within the pattern 270 to a second position "P2." A third distance "D3" can be the axial distance for the lug 272 to travel within the pattern 270 to a third position "P3." The time interval for the lug 272 to travel the first distance "D1" to position "P1" can be "TID1." The time interval for the lug 272 to travel back or return along the first distance "D1" can be "T2D1." Similarly, the time interval for the lug 272 to travel the second distance "D2" to position "P2" can be "TID2" and the time interval to return can be "T2D2." The time interval for the lug 272 to travel the third distance "D3" to position "P3" can be "TID3" and the time interval to return can be "T2D3."

Figure 3A:
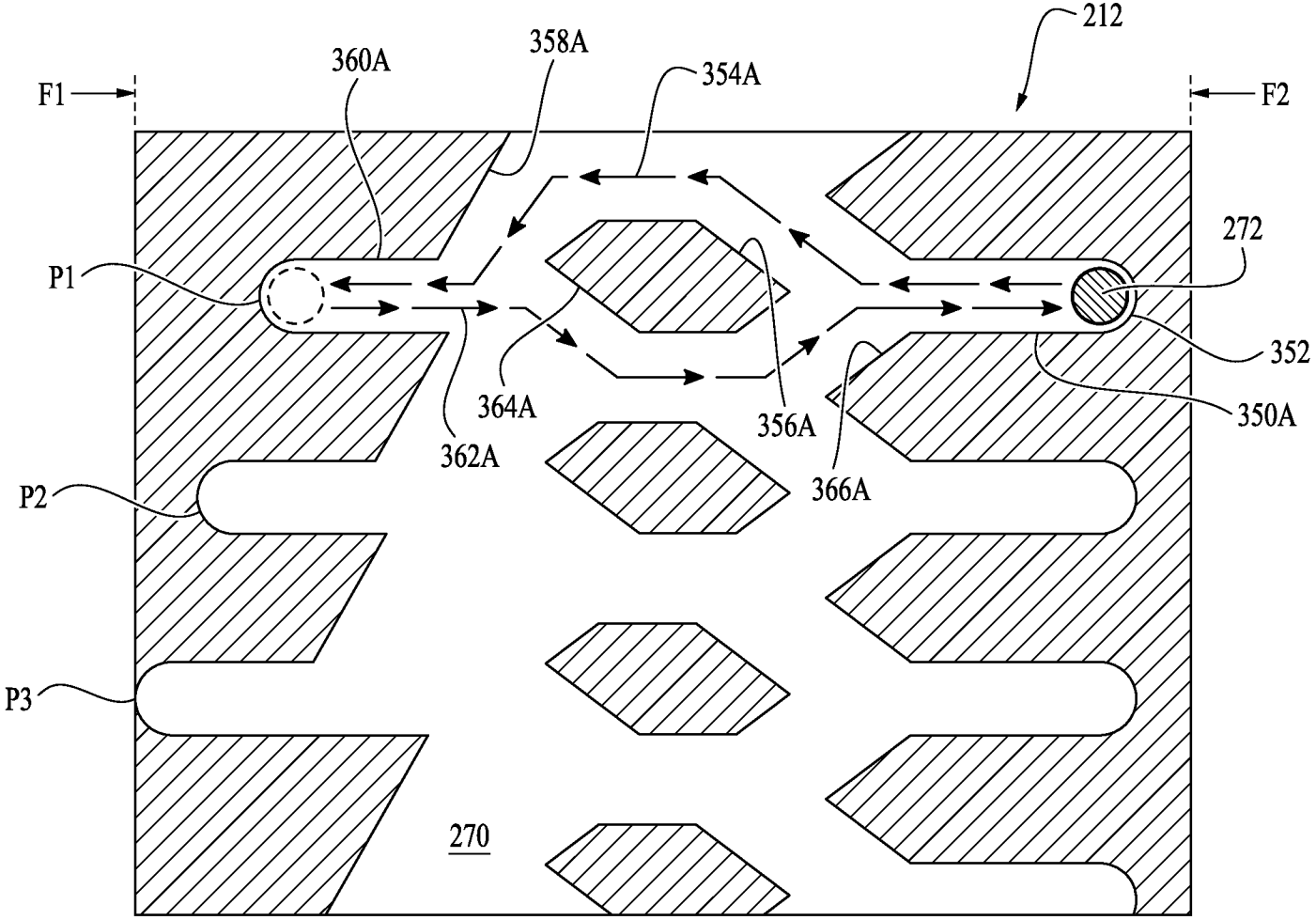
FIG. 3A is an unrolled view of an inner surface of a control device illustrating a lug path for a first position according to an embodiment of the disclosure.

The lug 272 can be guided through the pattern 270 by the placement of one or more angled sides. Turning now to FIG. 3A, an unrolled view of an inner surface of a control device can be described. In some embodiments, the position control device 212 can be a cylinder with a series of slots and/or grooves formed along the inner surface 266. The lug 272 can be positioned in a first slot 350 for conveying the selective tool 200 into the string of casing 108. The first slot 350, e.g., groove, can be aligned with the first position "P1" by the pattern 270. A force "F2" applied to the control device 212 from the one or more return springs 320 can retain or position the lug 272 in a first reset position 352, e.g., end of the first slot 350. As shown in FIG. 2A, the one or more scraper blades 220 can be retained in an inactive position, e.g., positioned on the lower surface 260 of the wedge 230 in response to the lug 272 being located in the first reset position 352.

The lug 272 can travel along a lug path to the first position "P1" in response to the first force "F1", e.g., activation force, being greater than the second force "F2", e.g., reset force. The lug path can comprise a set path 354 and a reset path 362 for each of the positions. The first force "F1" can be the activation force via the piston assembly 208. In some embodiments, a flowrate of wellbore fluids 302 through the fluid passage 234 can generate a first force "F1" to axially translate the control device 212 over the lug 272. For example, a wellbore servicing operation can deliver a flowrate of the wellbore fluids 302 at a predetermined flowrate for a predetermined time interval to axially translate the lug 272 along the first set path 354A to the first position "P1." The lug 272 can travel, e.g., axially translate, along the first slot 350 from the first reset position 352 to contact a first angle surface 356. The contact with the first angle surface 356 can rotationally translate and axially translate the lug 272 along the first set path 354A until the lug 272 is no longer in contact with the angle surface 356. The lug 272 can travel, e.g., axially translate, along the first set path 354A until the lug 272 contacts the second angle surface 358. The contact with the second angle surface 358 can rotationally translate and axially translate the lug 272 along the first set path 354A until the lug 272 enters a configuration slot 360. The time interval for the lug 272 to travel a first set path 354A to the first position "P1" can be "T1D1." Although the lug 272 is described as following the lug path through the pattern 270, it is understood that the motion is relative and thus, the control device 212 can axially and rotationally translate about a static embodiment of the lug 272 or the lug 272 can axially and rotationally translate through the pattern 270 of the static embodiment of the control device 212.

Continuing with FIG. 3A, the lug 272 can be located in the first position "P1" in response to the first force "F1" and the pattern 270 directing the lug 272 though the first set path 354A. As shown in FIG. 2C, the first position "P1" in the control pattern 270 can restrain and/or prevent the control device 212 from axially translating the wedge 230 under the one or more scraper blades 220 to deploy or extend the one or more blades 220 from the housing 226. In some embodiments, the wellbore servicing operation can perform a portion of the servicing operation without the selective tool 200 active, e.g., the one or more scraper blades deployed. For example, the portion of the servicing operation can include pumping wellbore servicing fluids through the workstring 122, conveying the workstring 122 through the casing string 108, rotating the workstring 122, or combinations thereof.

The lug 272 can return to the first reset position 352 by the removal of the first force "F1," e.g., the activation force. In some embodiments, the servicing operation can stop pumping wellbore fluids down the workstring 122. The reset force "F2," e.g., spring 320, can bias the control device 212 to axially translate and return the piston 276 of the device 208 to the run-in position or first position. The reset force "F2" can axially translate the control device 212, the metering device 206, and the device 208 to the run-in position. The lug 272 can exit the first position "P1," travel along the configuration slot 360A to contact a third angled surface 364A. The contact with the third angle surface 364A can rotationally translate and axially translate the lug 272 along the reset path 362 until the lug 272 is no longer in contact with the surface 364A. The lug 272 can travel, e.g., axially translate, along the reset path 362A until the lug 272 contacts a fourth angled surface 366A. The contact with the fourth angle surface 366A can rotationally translate and axially translate the lug 272 along the reset path 362A until the lug 272 enters the first slot 350A. The time interval for the lug 272 to travel a first reset path 362A to the first reset position can be "T2D1."

In some scenarios, the wellbore servicing operation can convey the selective tool 200 into the casing string 108 with the selective tool 200 in the run-in position, e.g., the first reset position 352. In a scenario, the wellbore servicing operation can include a pumping operation for a time interval longer than "TID1" to locate the lug 272 into the first position "P1." For example, the wellbore operation can circulate fluids down the workstring 122, through the cleanout string 124, out the drill bit 132, and return fluids to surface for a time period greater than "TID1" as part of a wellbore servicing operation. In a scenario, the wellbore servicing operation may stop pumping fluid for a time period greater than "T2D1" to allow the selective tool 200 to return to the first reset position 352.

Figure 3B:
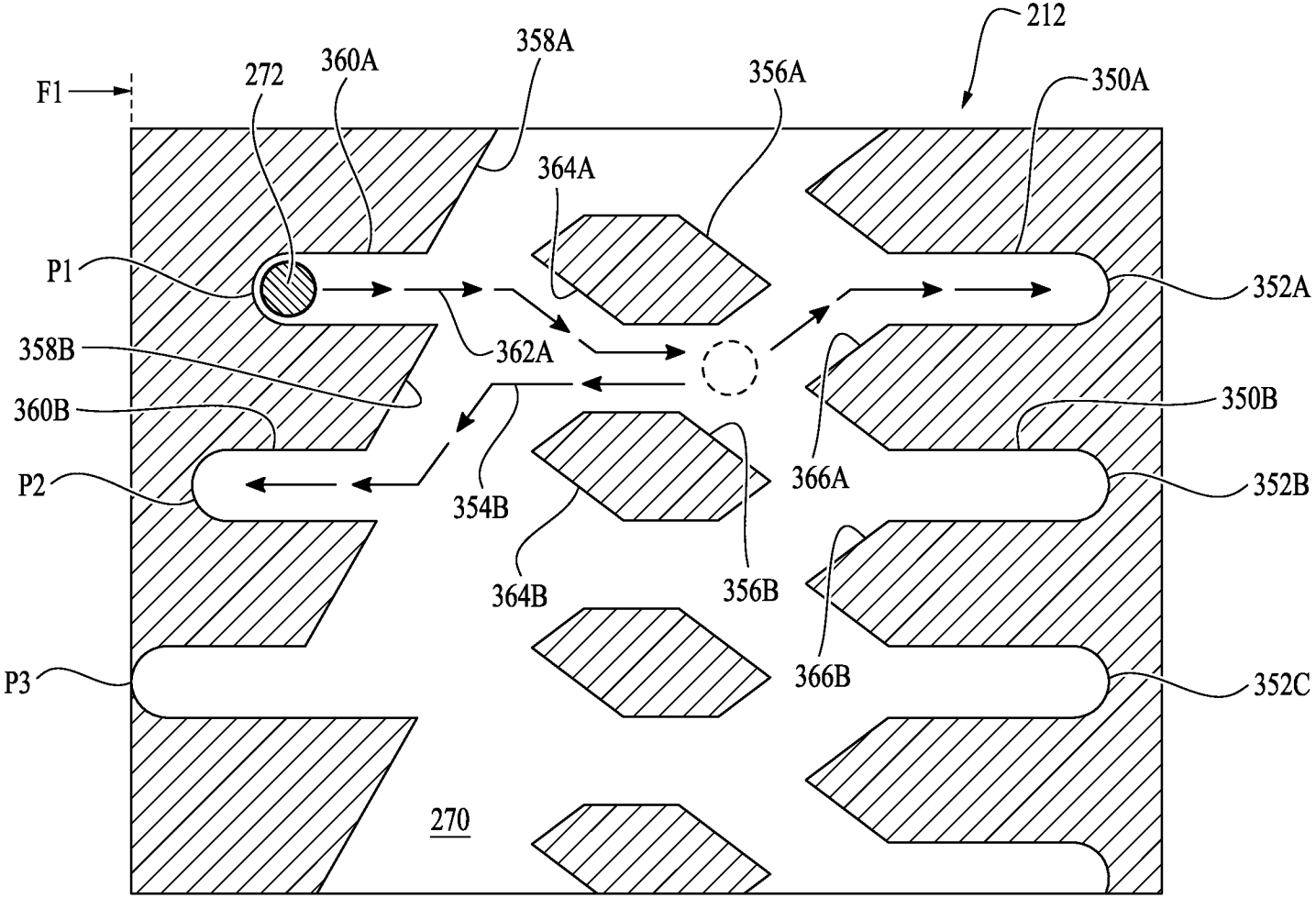
FIG. 3B is an unrolled view of an inner surface of a control device illustrating a lug diverting to a second lug path according to an embodiment of the disclosure.

The wellbore servicing operation may determine a need to position the tool into a second position "P2." Turning now to FIG. 3B, an unrolled view of an inner surface of a cylinder with the second position can be described. In a scenario, the wellbore servicing operation may begin a first pumping operation for a predetermined time, e.g., "T1D1," to place the lug 272 into the first position "P1." The wellbore servicing operation my stop pumping for a predetermined time to allow the lug 272 to travel along a portion of the first reset path 362A. Before the lug 272 enters slot 350A, the wellbore servicing operation may begin a second pumping operation to generate the force "F1" and the lug 272 may travel along a second set path 354B for a predetermined time to reach the second position "P2." The second set path 364B can be identical to first set path 364A with a second angle surface 358B that directs the lug 272 into a slot 360B with the position "P2."

Figure 3C:
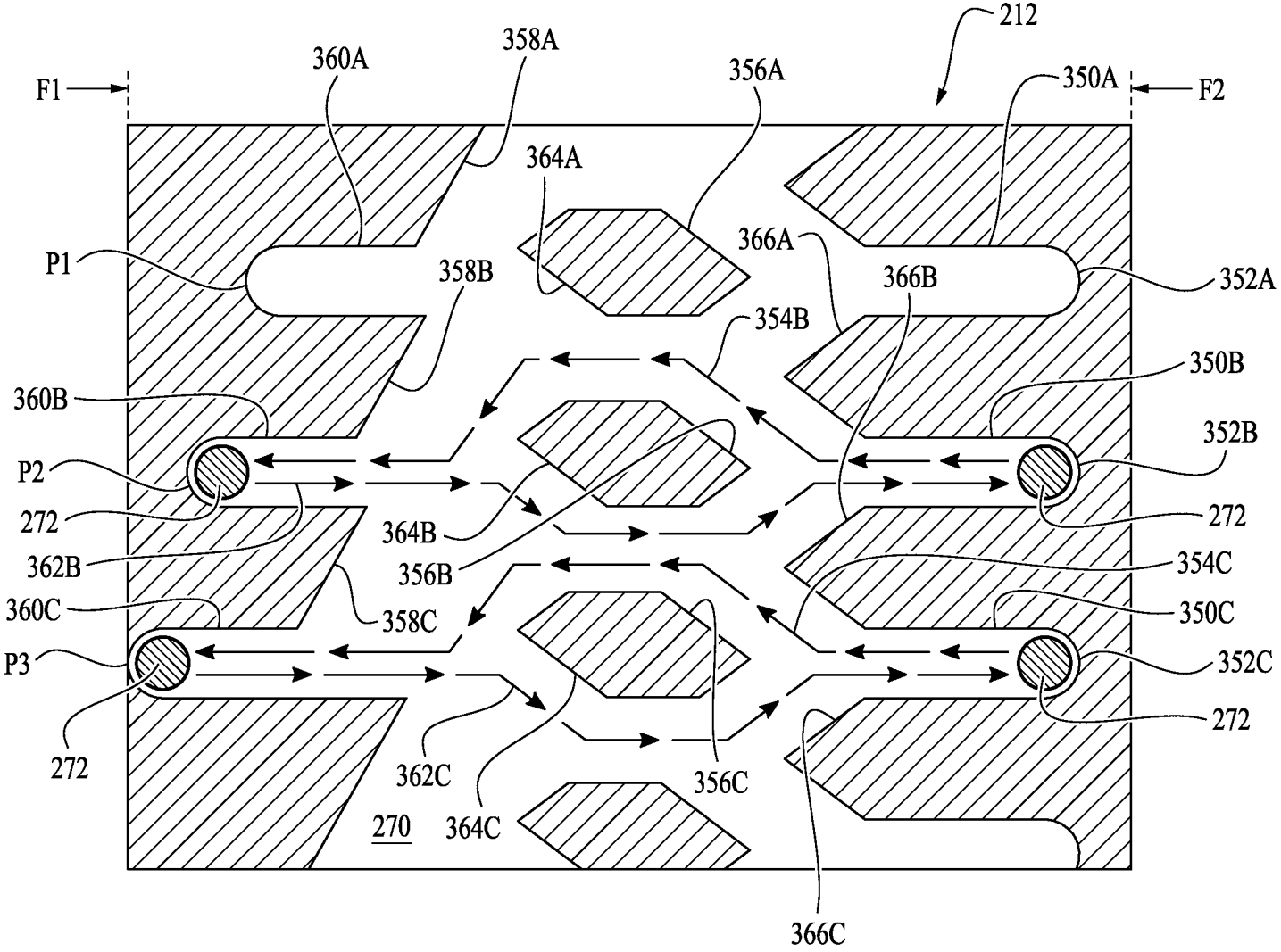
FIG. 3C is an unrolled view of an inner surface of a control device illustrating a lug path for the second and third position according to an embodiment of the disclosure.
Figure 4:
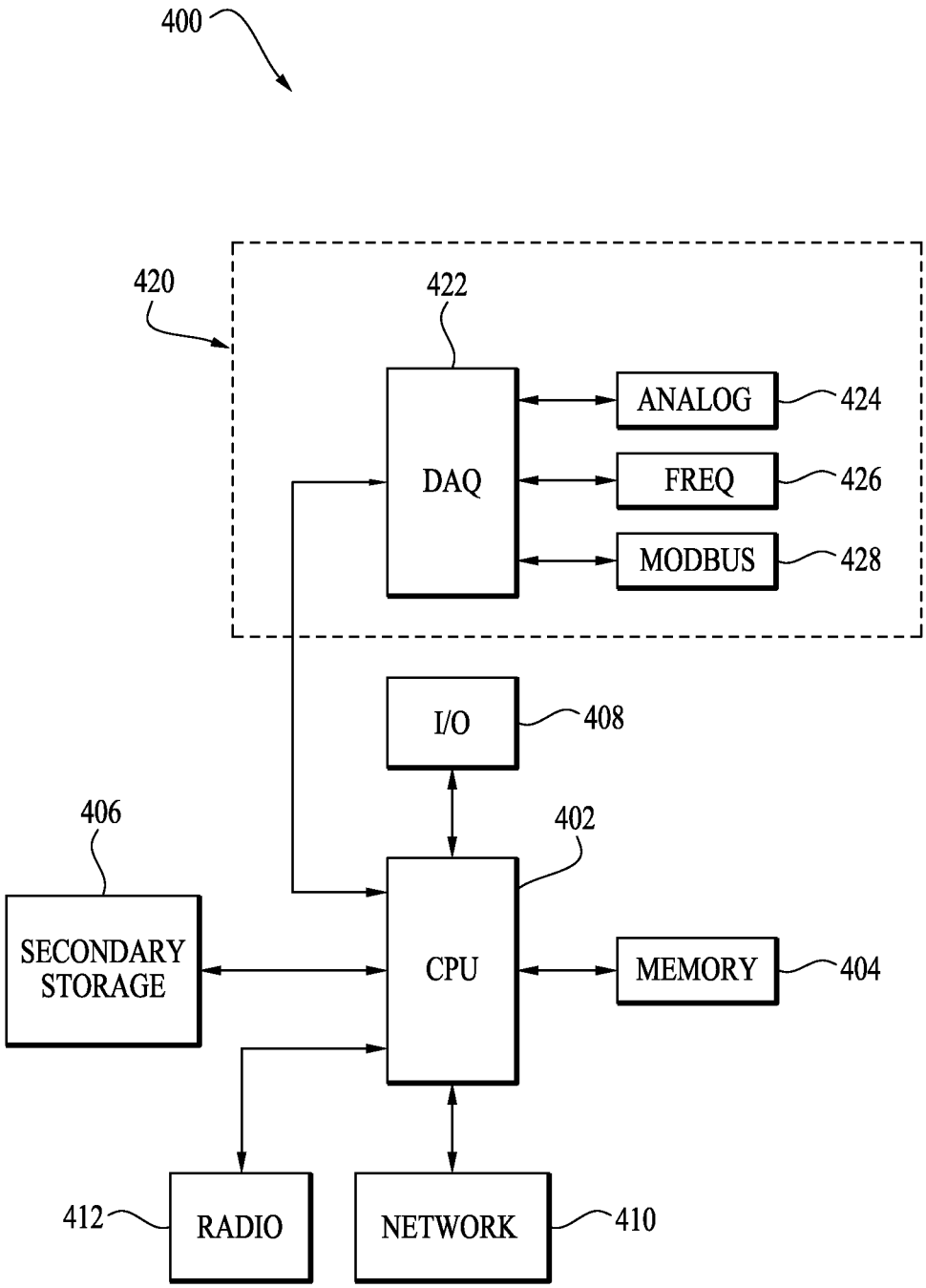
FIG. 4 is a block diagram illustrating an exemplary computer system according to an embodiment of the disclosure.

The pattern 270 within the control device 212 can be a repeating pattern with identical or substantively identical set paths 354A-C, and reset paths 362A-C. Turning now to FIG. 3C, the unrolled view of an inner surface of a cylinder with the second position can be described. A second set path 354B can comprise identical or near identical angled surfaces, e.g., surface 356B, to direct the lug 272 along the lug path. For example, the lug 272 can travel, e.g., axially translate, along the second slot 350B from the second reset position 352B to contact a first angled surface 356B, rotationally and axially translate the lug 272 along the second set path 354B until the lug 272 is no longer in contact with the surface 356B and the lug 272 contacts the second angle surface 358B. The contact with the second angle surface 358B can rotationally and axially translate the lug 272 along the second set path 354B until the lug 272 enters a second slot 360 and contacts the second position P2. The time interval for the lug 272 to travel a second set path 354B to the second position can be "TID2."

The lug 272 can return from the second position "P2" to the second reset position 352B along the second reset path 362B. As previously described, the reset force "F2," e.g., spring 320, can bias the control device 212 to axially translate so that the lug 272 can exit the second position "P2," travel along the slot 360B to contact a third angled surface 364B and rotationally and axially translate the lug 272 along the second reset path 362B until the lug 272 is no longer in contact with the angled surface 364B. The lug 272 can travel along the second reset path 362B until the lug 272 contacts a fourth angled surface 366B and rotationally and axially translate until the lug 272 enters the second slot 350B. The time interval for the lug 272 to travel a second reset path 362B to the second reset position 352B can be "T2D2."

Figure 2D:
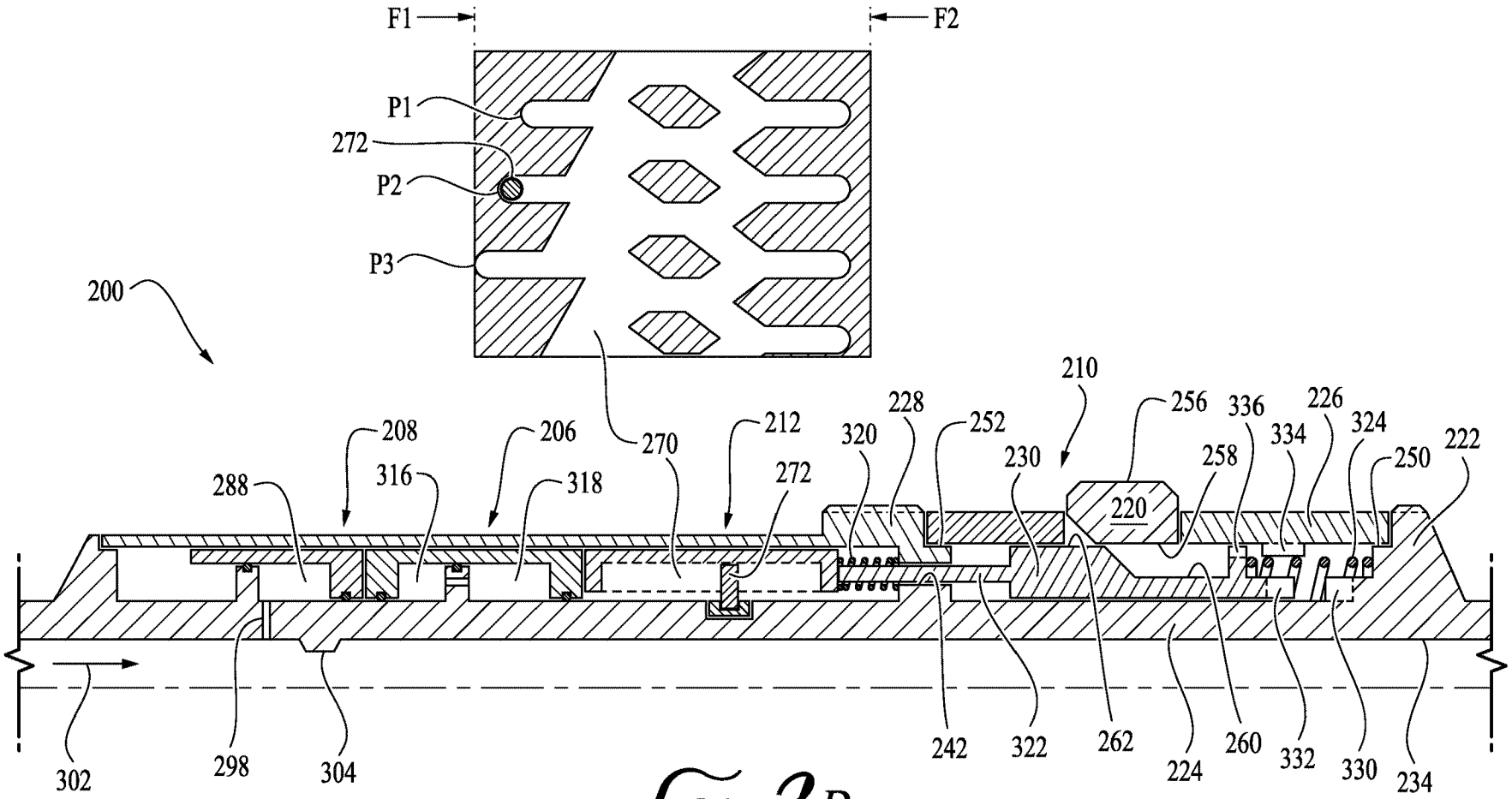
FIG. 2D is a partial cross-sectional view of a selectable scraper tool in a second position according to an embodiment of the disclosure.

Returning to FIG. 2D, the selective tool 200 may be configured in a non-rotating scraper mode in response to the lug 272 being located in the second position "P2." In some embodiments, the wellbore servicing operation can include a pumping operation that retains the lug 272 in the second position "P2." The second position "P2" can compress the one or more return springs 320 and the housing spring 324 to axially translate the wedge 230 via one or more control rods 322 coupled to the wedge 230. The one or more control rods 322 can include a sliding fit within the corresponding one or more rod ports 242. The one or more scraper blades 220 can extend radially outward from the housing 226 as the inner surface 258 of the blade 220 moves from the lower surface 260 to the upper surface 262 of the wedge 230. The outer surface 256 of the one or more blades 220 may be in contact with the inner surface 112 of the casing string 108. Although FIG. 2D illustrates a portion of the inner surface 258 engaged with or in contact with the upper surface 262, it is understood that 10%, 20%, 30%, 40%, 50%, 60%, 70%, 80%, 90%, 100%, or any fraction therebetween of the inner surface 258 of the blade 220 may be supported by the wedge 230.

The wellbore servicing operation can perform a wellbore cleaning operation with the selective tool 200 configured in the non-rotating scraper mode. For example, the one or more scraper blades 220 and the housing 226 may remain rotationally stationary, e.g., non-rotating, as the workstring 122 coupled to the chassis of the selective tool 200, e.g., the first stabilizer 222, the first mandrel 224, second stabilizer 228, and second mandrel 254, rotates during the wellbore cleaning operation. In some embodiments, the inner surface 246 of the housing 226 can rotate about the outer surface 250 of the first stabilizer 222 and the outer surface 252 of the second stabilizer 228.

In some embodiments, the wellbore cleaning operation may reconfigure the selective tool 200 from the non-rotating scraper mode to a rotating scraper mode. Referring back to FIG. 3C, the wellbore cleaning operation cycle or reconfigure the selective tool 200 by stopping the pumping operation for a predetermined time interval to allow the lug 272 to travel a portion of the reset path 362B. The pumping operation may begin again after the predetermined time interval to place the lug 272 within the path 354C and (after a predetermined time period) located the lug 272 within the third position "P3."

A third set path 354C can comprise identical or near identical angled surfaces, e.g., surface 356C, to direct the lug 272 along the lug path. For example, the lug 272 can travel, e.g., axially translate, along the third slot 350C from the third reset position 352C to contact a first angled surface 356C, rotationally and axially translate the lug 272 along the third set path 354C until the lug 272 is no longer in contact with the surface 356C and the lug 272 contacts the second angle surface 358C. The contact with the second angle surface 358C can rotationally and axially translate the lug 272 along the third set path 354C until the lug 272 enters a third slot 360C and contacts the third position P3. The time interval for the lug 272 to travel a third set path 354C to the third position "P3" can be "TID3."

The lug 272 can return from the third position "P3" to the third reset position 352C along the third reset path 362C. As previously described, the reset force "F2," e.g., spring 320, can bias the control device 212 to axially translate so that the lug 272 can exit the third position "P3," travel along the third slot 360C to contact a third angled surface 364C and rotationally and axially translate the lug 272 along the third reset path 362C until the lug 272 is no longer in contact with the surface 364C. The lug 272 can travel along the third reset path 362C until the lug 272 contacts a fourth angled surface 366C and rotationally and axially translate until the lug 272 enters the third slot 350C. The time interval for the lug 272 to travel a third reset path 362C to the third reset position 352C can be "T2D3."

Although the position control device 212 is described with the pattern 270 located about the inner surface 266, it is understood that the position control device 212 can be an assembly of two or more parts, e.g., a body and a housing, coupled together. In some embodiments, the control device 212 and the lug 272 can swap places with the pattern 270 located on the outer surface 268 of the second mandrel 254 and the lug 272 and lug ring 274 can be located on the control device 212.

Figure 2E:
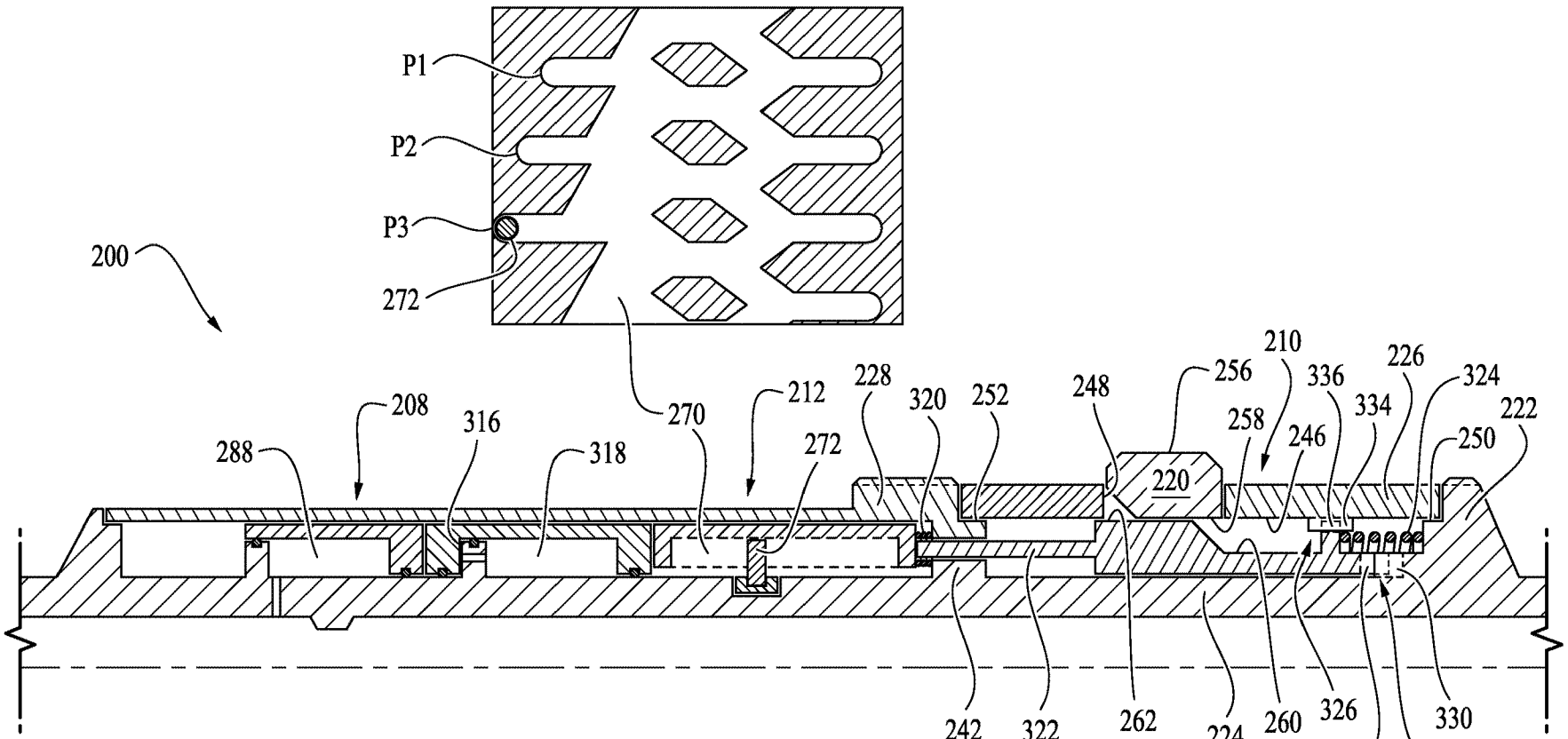
FIG. 2E is a partial cross-sectional view of a selectable scraper tool in a third position according to an embodiment of the disclosure.

Turning to FIG. 2E, the selective tool 200 may be configured in a rotating scraper mode in response to the lug 272 being located in the third position "P3." In some embodiments, the wellbore servicing operation can include a pumping operation that retains the lug 272 in the second position "P2." The third position "P3" can compress the one or more return springs 320 and the housing spring 324 to axially translate the wedge 230 via one or more control rods 322 to couple a mandrel clutch 326 and/or a housing clutch 328. The mandrel clutch 326 can comprise a set of mandrel castellations 330 engaged with a set of axial wedge castellations 332. The housing clutch 328 can comprise a set of housing castellations 334 engaged with radial wedge castellations 336. The mandrel clutch 326 and/or housing clutch 328 can rotationally couple the housing 226 to the wedge 230 and/or the first mandrel 224 so that the housing 226 and one or more scraper blades 220 within the windows 248 rotate with the first mandrel 224. Although the mandrel clutch 326 and housing clutch 328 are described as comprising castellations, it is understood that the mandrel clutch 326 and housing clutch 328 can be formed by any shape that can engage or mesh or couple together, for example, gear teeth, spines, serrations, key way, or any other suitable coupling mechanism. The one or more scraper blades 220 can remain radially extended from the housing 226 and the inner surface 258 of the blade 220 can be engaged with the upper surface 262 of the wedge 230. The outer surface 256 of the one or more scraper blades 220 may be in contact with the inner surface 112 of the casing string 108.

The wellbore servicing operation can perform a wellbore cleaning operation with the selective tool 200 configured in the rotating scraper mode. For example, the one or more scraper blades 220 and the housing 226 may be rotationally coupled to the chassis of the selective tool 200, e.g., mandrel 224, rotate in response to rotation of the workstring 122 during the wellbore cleaning operation.

Although the selective tool 200 is described as operating in a second configuration after being reconfigured from a first configuration, it is understood that the selective tool 200 can be reconfigured from a first configuration, to a second configuration, and then to a third configuration before a wellbore servicing operation begins.

Although the scraper actuator 214 is described as generating the activation force "F1" via a piston assembly 208 and the metering assembly 206, it is understood that the activation device can be any type of actuator configured to axially move or allow axial movement of distance "D3." In an embodiment, the scraper actuator 214 can be i) a hydraulic system with a volume of fluid and a pump, ii) a single pressure source with a manifold, iii) a gas generator with a manifold, iv) a motor driving a gear system, v) a motor turning a threaded extension, or vi) an electromagnetic extend-retract actuator. In an embodiment, a pump actuator 214 comprises a first chamber and a second chamber fluidically connected to a battery powered or surface powered downhole pump that moves the sleeve actuator 214 to a second position by transferring a volume of fluid from a first chamber to a second chamber. In an embodiment, pressure actuator 214 comprises a pressure source fluidically coupled to a first chamber by a manifold that moves the sleeve actuator 214 to a second position by transferring a volume of fluid or gas to the first chamber. In an embodiment, a gear actuator 214 comprises a motor rotationally coupled to a gear system engaged to a threaded surface on a mandrel or extension rod that moves the gear actuator 214 to a second position by moving the gear system along the threaded surface. In an embodiment, the electromagnet actuator 214 comprises a plurality of electromagnets magnetically coupled to a plurality of permanent magnets on a mandrel that move the electromagnet actuator 214 to a second position by moving the permanent magnets relative to the electromagnets.

The selective tool 200 may comprise a unit controller coupled to the scraper actuator 214 to control the position of the lug 272 within the pattern 270 of the control device 212. In an embodiment, the unit controller can comprise a processor, non-transitory memory, one or more sensors, and a communication device. The one or more sensors can include a pressure sensor fluidically coupled to the fluid passage 234 and one or more positional sensors coupled to the control device 212. The pressure sensor can determine a pumping pressure value within the fluid passage 234 in response to a pumping operation. The unit controller can receive signals from the surface, for example, pressure applied to the fluid passage 234 of the selective tool 200. The unit controller can direct the scraper actuator 214 to position the lug 272 into a first position "F1," a second position "F2," and/or a third position "F3." The unit controller may direct one or more components of the scraper actuator 214, for example, the pump, the manifold, the motor, or the plurality of electromagnets.

Turning now to FIG. 7, a computer system 700 suitable for implementing one or more embodiments of the unit controller including without limitation any aspect of the computing system associated with the scraper actuator of FIG. 2. The computer system 700 includes one or more processors 702 (which may be referred to as a central processor unit or CPU) that is in communication with memory 704, secondary storage 706, input output devices 710, and network devices. The computer system 700 may continuously monitor the state of the input devices and change the state of the output devices based on a plurality of programmed instructions. The programming instructions may comprise one or more applications retrieved from memory 704 for executing by the processor 702 in non-transitory memory within memory 704. The input output devices may comprise a Human Machine Interface with a display screen and the ability to receive conventional inputs from the service personnel such as push button, touch screen, keyboard, mouse, or any other such device or element that a service personnel may utilize to input a command to the computer system 700. The secondary storage 706 may comprise a solid state memory, a hard drive, or any other type of memory suitable for data storage. The secondary storage 706 may comprise removable memory storage devices such as solid state memory or removable memory media such as magnetic media and optical media, i.e., CD disks. The computer system 700 can communicate with various networks with the network devices 714 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 700 may include a transceiver 218 for communicating wirelessly.

In some embodiments, the computer system 700 may comprise a DAQ card 716 for communication with one or more sensors. The DAQ card 716 may be a standalone system with a microprocessor, memory, and one or more applications executing in memory. The DAQ card 716 may be a card or a device within the computer system 700. In some embodiments, the DAQ card 716 may be combined with the input output device 710. The DAQ card 716 may receive one or more analog inputs, one or more frequency inputs, and one or more Modbus inputs. For example, the analog input may include a positional sensor, e.g., a linear sensor. For example, the frequency input may include a flow meter, i.e., a fluid system flowrate sensor. For example, the Modbus input may include a pressure transducer. The DAQ card 716 may convert the signals received via the analog input, the frequency input, and the Modbus input into the corresponding sensor data. For example, the DAQ card 716 may convert a frequency input from the flowrate sensor into flowrate data measured in gallons per minute (GPM).

ADDITIONAL DISCLOSURE

The following are non-limiting, specific embodiments in accordance and with the present disclosure.

A first embodiment, which is a wellbore cleaning tool configurable for cleaning an inner surface of a downhole tubular, comprising: a tool mandrel generally cylinder in shape with an outer surface, an inner fluid passage, one or more fluid ports, and a mandrel clutch; a scraper actuator located on the tool mandrel configured to generate an activation force, wherein the scraper actuator is fluidically coupled to the one or more fluid ports; a blade assembly located on the tool mandrel proximate the mandrel clutch comprising one or more scraper blades located in corresponding windows in a housing; and a control device located on the tool mandrel between the scraper actuator and the blade assembly comprising at least one lug located within a control pattern; wherein an outer surface of each of the one or more scraper blades is configured to contact the inner surface of the downhole tubular in the extended position.

A second embodiment, which is the wellbore cleaning tool of the first embodiment, wherein: the one or more fluid ports are fluidically coupled to the fluid passage within the tool mandrel; wherein fluid pressure within the fluid passage is generated in response to a pumping operation; and wherein fluid pressure applied to one or more fluid ports generates the activation force via the scraper actuator.

A third embodiment, which is the wellbore cleaning tool of the second embodiment, wherein the scraper actuator comprises i) a piston comprising a fluid chamber coupled to the one or more fluid ports, ii) a hydraulic system with a volume of fluid and a pump, iii) a single pressure source with a manifold, iv) a gas generator with a manifold, v) a motor driving a gear system, vi) a motor turning a threaded extension, vii) an electromagnetic actuator, or ix) combinations thereof.

A fourth embodiment, which is the wellbore cleaning tool of the third embodiment, wherein the scraper actuator further comprises a metering assembly configured to i) travel a first distance in a first direction within a first time interval and ii) travel a second distance in a second direction within a second time interval.

A fifth embodiment, which is the wellbore cleaning tool of the fourth embodiment, wherein: the metering assembly comprises a volume of fluid within a first chamber fluidically coupled to a second chamber by one or more metering devices; wherein the fluid is substantially incompressible; and wherein the one or more metering devices regulate a flowrate of fluid from the first chamber to the second chamber in the first direction and from the second chamber to the first chamber in the second direction.

A sixth embodiment, which is the wellbore cleaning tool of the first embodiment, wherein the control pattern comprises a first position and a second position, wherein the lug located in the first position configures the blade assembly in a retracted position, and wherein the lug located in the second position configures the blade assembly in an extended position.

A seventh embodiment, which is the wellbore cleaning tool of the first embodiment, wherein: the control device comprises at least two set positions selected from a group of i) a retracted position, ii) a non-rotating scraper position, and iii) a rotating scraper position; where the control pattern comprises a set path for directing the lug from a reset position to one of the at least two set positions; wherein the set path comprises one or more angled surfaces and a configuration slot with the at least two set positions a distance of i) D1, ii) D2, or iii) D3 from the reset position; and wherein the control pattern comprises a reset path for directing the lug from each of the set position to the reset position.

A eighth embodiment, which is the wellbore cleaning tool of the seventh embodiment, wherein: the lug travels along the set path in response to the scraper actuator applying an activation force; wherein the lug travels along the reset path in response to a biasing force from one or more reset springs; wherein the set path for the second position is coincident with the reset path of the first position; wherein the set path for a third position is coincident with the reset path of the second position; and wherein the set path for the first position is coincident with the reset path of the third position.

A ninth embodiment, which is the wellbore cleaning tool of the eighth embodiment, wherein: the lug travels from a first set position to a second set position in response to ending the activation force for a predetermined time period and reapplying the activation force at the end of the predetermined time period.

A tenth embodiment, which is the wellbore cleaning tool of the first embodiment, wherein: the one or more scraper blades are radially extended from a run-in retracted position to an extended position in response to a wedge axially translating from a first position to a second position; wherein the run-in position is the first position within the control device; wherein the extended position is the second position or a third position within the control device; wherein the control device axially translates the wedge via one or more control rods; and wherein a housing spring is configured to bias the wedge to return to the first position.

An eleventh embodiment, which is the wellbore cleaning tool of the tenth embodiment, further comprising: a housing clutch comprising a set of housing castellations on the inner surface of the housing and a set of radial castellations on the outer surface of the wedge; wherein the housing clutch is configured to allow rotation of the housing in response to not being engaged; and wherein the housing clutch is not engaged in the first and second position.

A twelfth embodiment, which is the wellbore cleaning tool of the eleventh embodiment, wherein: the housing clutch is engaged in the third position; wherein the set of housing castellations engage with the set of radial castellations; and wherein the housing clutch is configured to stop rotation of the housing in response to being engaged.

A thirteenth embodiment, which is a method of cleaning debris from a portion of a wellbore with one or more selective scraper tools, comprising: conveying one or more selective scraper tools, via a workstring, from a surface location to a target depth within the wellbore; pumping a wellbore fluid through a fluid passage within the selective scraper tool via the workstring; extending one or more scraper blades from a housing by axially translating a wedge from a first position to a second position or a third position; conveying the selective scraper tool within a target zone within the wellbore; and returning the one or more selective scraper tools to a surface location.

A fourteenth embodiment, which is the method of thirteenth embodiment, further comprising: signaling a scraper actuator from the surface location to actuate a blade assembly by directing a lug within a control pattern to travel from the first position to the second position or the third position.

A fifteenth embodiment, which is the method of thirteenth or fourteenth embodiment, further comprising: axially translating the wedge from a first position to the second position or the third position in response to an activation force axially and rotationally translating a control device slidingly coupled with a lug; directing the lug within a control pattern of the control device to travel along a lug path from a reset location to a set position, wherein the lug path comprises one or more angled surfaces, wherein the lug path comprises a set path and a reset path, wherein the lug travels along the set path in response to the activation force, and wherein the lug travels along the reset path in response to a biasing force from a return spring; directing the lug from the first position within the control pattern to a subsequent position by stopping an actuation force for a predetermined time period and reapplying the actuation force after the predetermined time period, wherein the lug travels along the reset path in response to the biasing force of the return spring during the predetermined time period, and wherein the lug travels along a set path for the subsequent position in response to the activation force after the predetermined time period, and wherein the set path for the subsequent position is aligned with the reset path of the first position; and wherein the subsequent position is the second position or the third position.

A sixteenth embodiment, which is the method of any of the thirteenth through fifteenth embodiments, wherein the selective scraper is configured in a non-rotating scraper mode in the second position.

A seventeenth embodiment, which is the method of any of the thirteenth through sixteenth embodiments, wherein the selective scraper is configured in a rotating scraper mode in the third position.

An eighteenth embodiment, which is the method of any of the thirteenth through seventeenth embodiments, wherein: the one or more selective scraper tools are configured with the one or more scraper blades in contact with an inner surface of the wellbore a first target depth at a beginning the target zone; wherein the one or more selective scraper tools are conveyed to a second target depth at an end of the target zone with the one or more scraper blades in contact with the wellbore; and wherein the workstring is rotated in response to the one or more scrapers being configured in a rotating scraper mode.

A nineteenth embodiment, which is a downhole wellbore cleaning system, comprising: a selective scraper tool coupled to a workstring; and a debris removal tool coupled to the workstring proximate to the selective scraper tool, wherein the debris removal tool is i) a service packer, ii) a circulation valve, iii) a junk basket, iv) a casing scraper, v) a casing brush, vi) a well screen, vii) a milling shoe, viii) a drill bit, or ix) combinations thereof, wherein the selective scraper tool and debris removal tool are conveyed into a wellbore to a target depth via the workstring; wherein the selective scraper tool comprises one or more scraper blades located within corresponding windows in a housing, wherein the scraper blades are retracted in a first position, wherein the scraper blades are extended radially from the housing in a second position or a third position, wherein the scraper blades contact an inner surface of a wellbore in response to being extended radially; wherein the selective scraper tool is configured in a first position for conveyance into the wellbore; wherein the selective scraper tool is configured in a second position in response to a first wellbore cleaning operation utilizing a debris removal tool; and wherein the selective scraper tool is configured in the third position in response to a completion of the first wellbore cleaning operation.

A twentieth embodiment, which is the downhole wellbore cleaning system of the nineteenth embodiment, wherein: the second position of the selective scraper tool is a non-rotating scraper mode with the one or more scraper blades in contact with the inner surface of the wellbore; wherein a wedge is axially moved from a first position or a third position to a second position to radially extend the one or more scraper blades in the second position; and wherein the wedge is axially translated by a scraper actuator via a lug engaged in a control pattern, wherein an actuation force from the scraper actuator urges the wedge into the second position by placement of the lug into the second position of the control pattern.

A twenty-first embodiment, which is the downhole wellbore cleaning system of the nineteenth or twentieth embodiment, wherein: the third position of the selective scraper tool is a rotating scraper mode with the one or more scraper blades in contact with the inner surface of the wellbore;

wherein a wedge is axially moved from either a first position or a second position to a third position to radially extend the one or more scraper blades in the third position; wherein a set of radial wedge castellations engage a set of radial housing castellations; wherein the housing is rotationally coupled to the wedge by the engagement of the castellations; and wherein the wedge is axially translated by a scraper actuator via a lug engaged in a control pattern, wherein an actuation force from the scraper actuator urges the wedge into the third position by placement of the lug into the third position of the control pattern.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore cleaning tool for cleaning an inner surface of a downhole tubular, comprising:

a housing;

a tool mandrel comprising a generally cylindrical shape, an outer surface, an inner fluid passage, one or more fluid ports, and a mandrel clutch;

a wedge disposed between the tool mandrel and the housing;

a scraper actuator located on the tool mandrel and configured to generate an activation force, wherein the scraper actuator is fluidically coupled to the one or more fluid ports;

a blade assembly located on the tool mandrel proximate the mandrel clutch and comprising one or more scraper blades located in corresponding windows in the housing; and a control device located on the tool mandrel between the scraper actuator and the blade assembly, and comprising at least one lug located within a control pattern, wherein an outer surface of each of the one or more scraper blades is configured to contact the inner surface of the downhole tubular.

2. The wellbore cleaning tool of claim 1, wherein:

the one or more fluid ports are fluidically coupled to the fluid passage;

fluid pressure within the fluid passage is generated in response to a pumping operation; and fluid pressure applied to one or more fluid ports generates the activation force via the scraper actuator.

3. The wellbore cleaning tool of claim 2, wherein the scraper actuator comprises a piston comprising a fluid chamber coupled to the one or more fluid ports, a hydraulic system comprising a pump, a single pressure source comprising a manifold, a gas generator comprising a manifold, a motor configured to drive a gear system, a motor configured to turn a threaded extension, an electromagnetic actuator, or combinations thereof.

4. The wellbore cleaning tool of claim 3, wherein the scraper actuator further comprises a metering assembly configured to travel a first distance in a first direction within a first time interval and travel a second distance in a second direction within a second time interval.

5. The wellbore cleaning tool of claim 4, wherein:

the metering assembly comprises a first chamber fluidically coupled to a second chamber by one or more metering devices; and the one or more metering devices are configured to regulate a flowrate of fluid from the first chamber to the second chamber in the first direction and from the second chamber to the first chamber in the second direction.

6. The wellbore cleaning tool of claim 1, wherein the control pattern comprises a first position and a second position, wherein the lug being located in the first position configures the blade assembly in a retracted position, and wherein the lug being located in the second position configures the blade assembly in an extended position.

7. The wellbore cleaning tool of claim 1, wherein:

the control pattern comprises a set path for directing the lug from a reset position to a set position;

the set path comprises one or more angled surfaces; and the control pattern comprises a reset path for directing the lug from the set position to a reset position.

8. The wellbore cleaning tool of claim 7, wherein:

the lug is configured to travel along the set path in response to the scraper actuator applying an activation force;

the lug is further configured to travel along the reset path in response to a biasing force from one or more reset springs;

the set path for a second position is coincident with the reset path of a first position;

the set path for a third position is coincident with the reset path of the second position; and the set path for the first position is coincident with the reset path of the third position.

9. The wellbore cleaning tool of claim 8, wherein:

the lug is further configured to travel from a first set position to a second set position in response to ceasing the activation force for a time period and reapplying the activation force at an end of the time period.

10. The wellbore cleaning tool of claim 1, wherein:

the one or more scraper blades are configured to radially extend from a retracted position to an extended position in response to the wedge axially translating from a first position to a second position;

the control device is configured to axially translate the wedge via one or more control rods; and a housing spring is configured to bias the wedge to return to the first position.

11. The wellbore cleaning tool of claim 10, further comprising:

a housing clutch comprising a set of housing castellations on an inner surface of the housing and a set of radial castellations on an outer surface of the wedge;

wherein the housing clutch is configured to allow rotation of the housing when the housing clutch is disengaged.

12. The wellbore cleaning tool of claim 11, wherein:

the set of housing castellations is configured to engage the set of radial castellations; and the housing clutch is further configured to prevent rotation of the housing when the housing clutch is engaged.

13. The wellbore cleaning tool of claim 1, wherein the control device is configured to translate the wedge against the one or more scraper blades to transition the one or more scraper blades from a retracted position to an extended position.

14. A method of cleaning debris from a portion of a wellbore, comprising:

conveying a scraper tool, via a workstring, from a surface location to a target depth within the wellbore, wherein the scraper tool comprises:

a housing;

a tool mandrel comprising a generally cylindrical shape, an outer surface, an inner fluid passage, one or more fluid ports, and a mandrel clutch;

a wedge disposed between the tool mandrel and the housing;

a scraper actuator located on the tool mandrel and fluidically coupled to the one or more fluid ports;

a blade assembly located on the tool mandrel proximate the mandrel clutch and comprising one or more scraper blades located in corresponding windows in the housing; and a control device located on the tool mandrel between the scraper actuator and the blade assembly, and comprising at least one lug located within a control pattern;

pumping a wellbore fluid through the fluid passage via the workstring;

extending the one or more scraper blades by axially translating the wedge;

conveying the scraper tool within a target zone within the wellbore; and returning the scraper tool to the surface location.

15. The method of claim 14, further comprising:

signaling the scraper actuator from the surface location to actuate the blade assembly by directing the lug within the control pattern to travel from a first position to a second position.

16. The method of claim 14, further comprising:

axially translating the wedge in response to an activation force axially and rotationally translating the control device, which is slidingly coupled to the lug;

directing the lug within the control pattern to travel along a lug path from a reset location to a set position, wherein the lug path comprises one or more angled surfaces, a set path, and a reset path, wherein the lug travels along the set path in response to the activation force, and wherein the lug travels along the reset path in response to a biasing force from a return spring;

directing the lug from a first position within the control pattern to a subsequent position by ceasing an actuation force for a time period and reapplying the actuation force after the time period, wherein the lug travels along the reset path in response to the biasing force of the return spring during the time period, and wherein the lug travels along the set path in response to the activation force after the time period, and wherein the set path is aligned with the reset path.

17. The method of claim 14, wherein the scraper tool is configured to be in a non-rotating scraper mode.

18. The method of claim 14, wherein the scraper tool is configured to be in a rotating scraper mode.

19. The method of claim 14, wherein:

the one or more scraper blades contact an inner surface of the wellbore a first target depth at a beginning the target zone;

the scraper tool is conveyed to a second target depth at an end of the target zone with the one or more scraper blades in contact with the wellbore; and the workstring is rotated in response to the scraper tool being configured in a rotating scraper mode.

20. A wellbore cleaning system, comprising:

a scraper tool coupled to a workstring, the scraper tool comprising:

a housing;

a tool mandrel comprising a generally cylindrical shape, an outer surface, an inner fluid passage, one or more fluid ports, and a mandrel clutch;

a wedge disposed between the tool mandrel and the housing;

a scraper actuator located on the tool mandrel and fluidically coupled to the one or more fluid ports;

a blade assembly located on the tool mandrel proximate the mandrel clutch and comprising one or more scraper blades located in corresponding windows in the housing; and a control device located on the tool mandrel between the scraper actuator and the blade assembly, and comprising at least one lug located within a control pattern; and a debris removal tool coupled to the workstring proximate to the scraper tool.

21. The wellbore cleaning system of claim 20, wherein:

the debris removal tool comprises a service packer, a circulation valve, a junk basket, a casing scraper, a casing brush, a well screen, a milling shoe, a drill bit, or combinations thereof;

the scraper tool and the debris removal tool are configured to be conveyed into the wellbore to the target depth via the workstring;

the one or more scraper blades are configured to contact an inner surface of the wellbore when the one or more scraper blades are extended radially; and the wedge is configured to be axially translated by the scraper actuator to radially extend the one or more scraper blades.

22. The wellbore cleaning system of claim 21, wherein:

a set of radial wedge castellations is configured to engage a set of radial housing castellations;

the housing is rotationally coupled to the wedge by engagement of the castellations; and an actuation force from the scraper actuator urges the wedge.

* * * * *